US005350292A

United States Patent [19]

Sanders et al.

[11] Patent Number: 5,350,292

[45] Date of Patent: Sep. 27, 1994

[54] ELECTRICAL HALF CONNECTOR WITH CONTACT-CENTERING VANES

[75] Inventors: Stuart E. Sanders, Brandon; Fred P. Bauer, Mendenhall, both of Miss.

[73] Assignee: Magnetek, Los Angeles, Calif.

[21] Appl. No.: 6,313

[22] Filed: Jan. 19, 1993

Related U.S. Application Data

[63] Continuation-in-part of Ser. No. 680,699, Apr. 4, 1991, Pat. No. 5,260,678.

[51] Int. Cl.[5] ..... H01R 13/432

[52] U.S. Cl. ..... 439/733

[58] Field of Search ..... 439/246, 252, 381, 733, 439/733.1

[56] References Cited

U.S. PATENT DOCUMENTS

| | | | |
|---|---|---|---|
| 3,479,635 | 11/1969 | Stark et al. | 439/252 |
| 3,980,385 | 9/1976 | Hirokawa et al. | 439/246 |
| 5,195,913 | 3/1993 | Shattuck | 439/246 |

*Primary Examiner*—Gary F. Paumen

*Attorney, Agent, or Firm*—Seldon & Scillieri

[57] ABSTRACT

This inexpensive, small half connector includes at least one electrical terminal (usually a female contact). The half-connector body defines a hole to receive each terminal. Each terminal has at least one retaining element for engaging the half connector (e.g., a springy tang that snaps into behind an internal flange) to retain the terminal in the half connector. Each hole has a segment of relatively large transverse dimension to receive its terminal, generally with transverse clearance about the circumference of the terminal. Each hole also has a segment of reduced transverse dimension to receive the terminal and engage the retaining element(s) of that terminal to retain the terminal. Each hole has some integral feature—in other words, some structural element(s) integral with the half-connector body—for centering the terminal in the large-dimension segment of the hole. Preferably the integral element includes at least two and preferably three radially inward-extending protrusions from an inner wall of the large-dimension segment of the hole. Each of these is preferably very thin, ideally about 0.2 to 0.23 millimeter thick.

20 Claims, 3 Drawing Sheets

FIG. 1
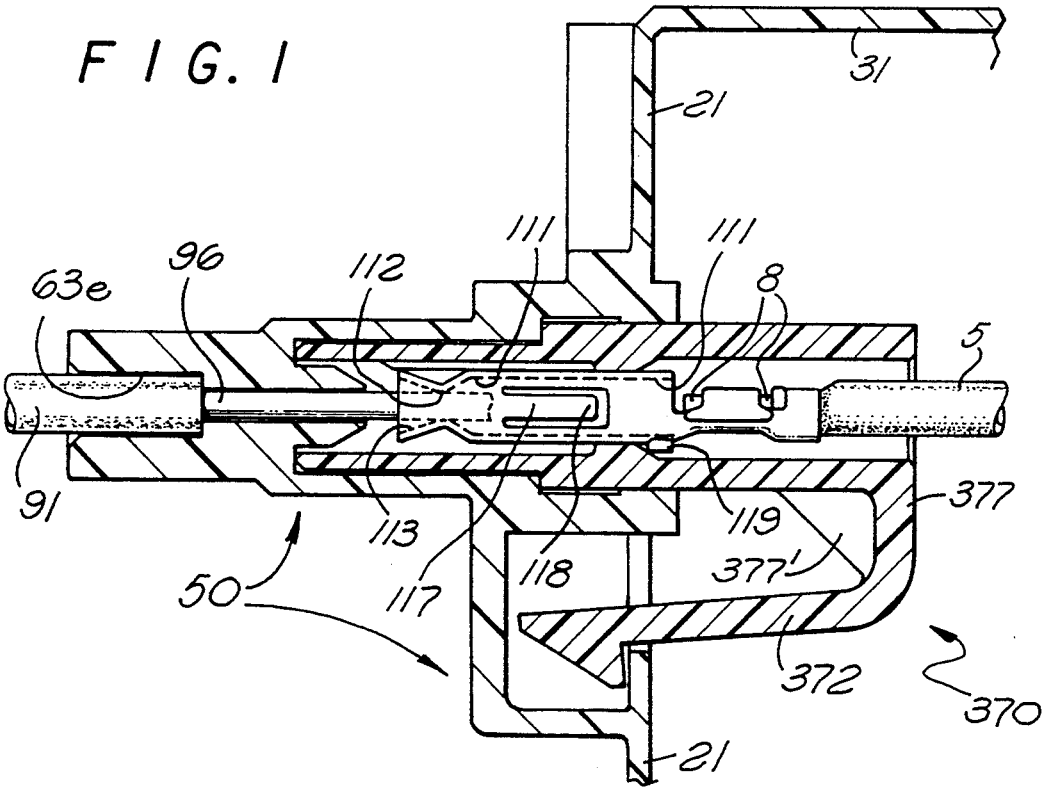
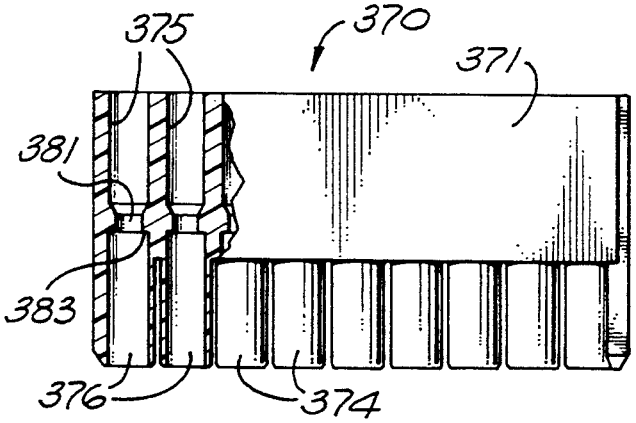
FIG. 2
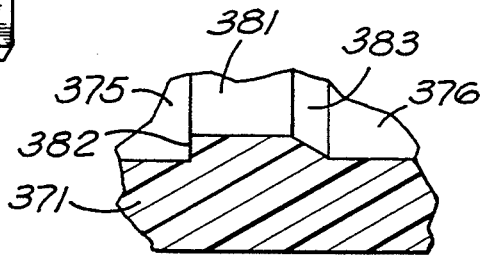
FIG. 4
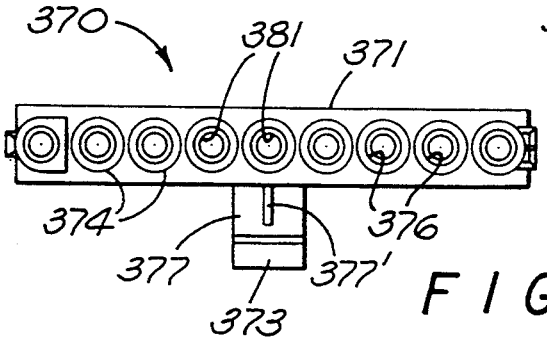
FIG. 3

ELECTRICAL HALF CONNECTOR WITH CONTACT-CENTERING VANES

RELATED PATENT DOCUMENT

This is a continuation-in-part of copending and commonly owned U. S. utility-patent application Ser. No. 07/680,699, filed on Apr. 4, 1991, and issued on Nov. 9, 1993, as U.S. Pat. No. 5,260,678.

BACKGROUND

1. Field of the Invention

This invention relates generally to small, inexpensive electrical connectors; and more particularly to high-manufacturing-volume half connectors which mate with other half connectors and contact pins that are of relatively rough construction. Such rough-construction pins are particularly favorable for making ballast connections in fluorescent. luminaires.

Thus the invention is particularly useful in a half connector that is to be installed in such a ballast, or in the mating half connector in the luminaire—whichever is the connector that carries the female contact or contacts. (In this document generally we use the words "contact" and "terminal" interchangeably; these words encompass both a male pin and a female receptacle for receiving such a pin.)

2. Prior Art

For economy the electrical half-connectors used to make ballast connections in some fluorescent luminaires, and doubtless in other applications as well, employ bared wire tips as inexpensive contact pins. Such pins often are well-controlled in position and tip shape than more-expensive pins.

Accordingly the positioning—in particular the centering within its half-connector cavity—of a female contact that mates with the bare-wire or other roughly formed pin more critical than ordinarily. The positioning uncertainty due to the relatively rough nature of the male pins adds to other sources of mismate, such as warpage of the parts, and the manufacturing tolerances inherent in inexpensive construction of both half-connector bodies, and improper or angular insertion in final assembly.

The resulting misalignment of the male and female contacts is very undesirable. In such a manufacturing environment the normal design precautions to avoid misalignment include, for example, increasing the pin-support length in the mating half connector, providing a bell-mouth lead-in segment to guide the pins into the female contacts, and tightening tolerances to the extent economically acceptable. Despite all such design efforts, misalignments still occur in final assembly.

Such misalignments at assembly time constitute a problematic source of hidden extra costs. In addition to the evident annoyance and delay at the assembly line, an unknown fraction of such misalignment problems can cause concealed damage to the contacts, most typically to the more fragile female contact.

As will be understood, such damage is likely to manifest itself later in assemblies which fail after latent defects are developed during shipment. For instance, failure can occult upon installation in a laboratory, home, etc.—or even after installation.

All such results are disproportionately expensive, taking into account the cost of physical replacement and paperwork processing, as well as the wasted cost of initial shipment, installation, and removal. For all these reasons, avoiding misalignment at the outset is highly desirable.

Some contacts are inherently centered within their respective through-holes in half-connector bodies, by virtue of close transverse spacing (in circular holes, this is radial spacing) between the contact and the interior wall of the through-hole. Such close spacing, however, requires use of relatively expensive contacts or relatively expensive half-connector molding shapes, or relatively expensive assembly procedures, or combinations of these undesirable features.

This is so because common contact designs incorporate laterally outward-springing tangs, or other retaining elements, to retain each connector in its hole. The use of close spacing is inconsistent—in terms of overall economy—with the need to leave a space inside each through-hole for expansion of the tangs or operation of other retaining elements.

For instance one terminal or contact that is on the market is square, and is for use in a square through-hole—except where transverse clearance is to be provided for expansion of metal tangs. Those tangs spring out laterally from sides of the contact to engage the interior of the through-hole, to retain the contact in the hole.

This type of contact requires additional operator attention and very slight additional time to orient each connector rotationally relative to its hole. The fractional seconds consumed in this effort, multiplied by many millions of pins, amount to unacceptable added cost.

One solution to this problem might be sought in the form of a separately formed centering ring or ferrule inserted into the hole at the forward end—in other words, the end that mates with the other half connector. The additional cost, however, of separately forming and assembling such a ferrule would be undesirable.

Accordingly it can be seen that many seemingly natural solutions to the problem posed here are foreclosed, or at least rendered economically adverse, by the extremely stringent cost considerations imposed by the high-manufacturing-volume, low-product-cost environment that has been described.

Some additional candidate solutions, which will be discussed in the following section of this document, are rendered relatively problematic by still other constraints that arise from the physical nature of the production process. In particular, connector bodies are most economically made by molding from plastic, and it is well understood that plastics molding imposes its own restraints upon a designer's freedom to give the inside of each through-hole a desired shape.

In particular, as is well known, molded parts with holes require provision, in the mold, of a pin corresponding to each desired hole—and each pin must be removable from the finished, molded part. The removal of each mold pin must be accomplished either by motion in the same direction in which the mold is parted (so that it can be performed as part of the same mechanical operation as parting of the mold), or in a different direction (and separate operation) from parting of the mold.

This fundamental characteristic of the molding process, combined with the relative costliness of employing pins that must be removed as a separate operation, militates against designing so-called "undercut" features into a molded part. By "undercut" we refer to any internal space that is relatively large in comparison with a relatively small opening nearer to the surface of the part—in the direction in which the main pins will be removed.

Providing the additional transverse pins needed to make undercut features, and the added time and effort required for insertion and withdrawal of those pins in each molding cycle, is sometimes called, in the molding industry, "double pull" molding. Double-pull operation is unacceptable or at least highly undesirable in the context of high-production-volume, low-price industrial items such as ballast and luminaire connectors.

This becomes particularly clear when the resulting potential for additional operating interruptions during each production run is taken into consideration. Therefore a "single pull" molding operation is extremely desirable for purposes of maintaining manufacturing throughput and economy; and as will be seen double-pull operations are unavoidably associated with some additional otherwise-inviting solutions to the situation discussed above.

As can now be seen, the prior art has failed to provide solutions to important problems of economy and efficiency in the manufacturing of certain kinds of connectors—particularly those employing relatively rough-construction male pins. These problems are especially significant in the fluorescent-luminaire industry.

SUMMARY OF THE DISCLOSURE

The present invention corrects this failing of the prior art. In its preferred embodiments, the present invention is an inexpensive small electrical half connector for use in completing at least one electrical circuit.

A preferred embodiment of the invention comprises at least one electrical terminal, each having at least one retaining element for engaging with the half connector to retain the terminal within the half connector. The preferred embodiment also includes a small and very inexpensive half-connector body that defines at least one hole formed through the body for receiving the at least one terminal respectively.

Each hole has at least one segment of relatively large transverse dimension for receiving the respective terminal, with transverse clearance about substantially the entire circumference of the terminal. In addition each hole has at least one segment of reduced transverse dimension, for receiving the respective terminal and engaging with the at least one retaining element of the respective terminal to retain the terminal.

Further, each hole has some means for approximately centering the terminal in the large-transverse-dimension segment of the hole. For purposes of generality and breadth in describing our invention we shall refer to these means simply as the "centering means".

The centering means are integral with the half-connector body or, to put it another way, are integral with the interior surface of the hole; by "integral" in this document we mean formed or manufactured as a single piece of material—i.e., as a practical matter, molded with the rest of the connector body all at the same time and from the same flowable stock to make a unitary article. For brevity in certain of the appended claims we describe these centering means as "integral means for approximately centering the terminal . . . ."

Although as mentioned above our invention is applicable to connectors having a single contact in a single hole, moist or at least some half connectors in accordance with our invention have multiple contacts—for example, nine contacts—and correspondingly multiple holes. In such cases the half-connector body and multiple corresponding occurrences of the integral centering means will all be formed as a single piece.

The foregoing may be a description or definition of the present invention in its broadest or most general terms. Even in such general or broad forms, however, as can now be seen the invention resolves the previously outlined problems of the prior art.

In particular, even though the terminal has lateral clearance substantially all about the circumference of the hole, the terminal is held approximately centered in the hole so that even rough-formed male pins, even if inserted quickly or somewhat carelessly at odd angles, will be guided reliably into the female terminal—without damage to either contact. This is accomplished without resort to square-section or other terminals or holes that require expensive extra assembly work, and without molding any added part, and also without need for economically adverse tolerances.

Although the invention thus provides very significant advances relative to the prior art, nevertheless for greatest enjoyment of the benefits of the invention it is preferably practiced in conjunction with certain other features or characteristics which enhance its benefits.

For example, it is preferred that the centering means comprise a plurality of inward-extending protrusions from an inner wall of the large-transverse-dimension segment of the hole, for engaging the terminal. Even more highly preferred is that the centering means comprise at least three such protrusions, inasmuch as the use of only two may not entirely eliminate the need for an extra substep of rotational orientation during assembly.

We also prefer that each of the inward-extending protrusions be less than 0.4 millimeter (0.015 inch) thick. As will be seen from the preferred orientation and disposition of the protrusions—which is detailed below—keeping the protrusions very thin imparts several advantageous properties to the finished half connector.

In addition we consider it preferable that each of the inward-extending protrusions have a height which is roughly equal to half the difference between the entire relatively large transverse dimension and the entire reduced transverse dimension. In cases where each hole is substantially circular in cross-section, the transverse dimensions can be identified as diameters, and the half-difference mentioned above can be identified as the radial difference—i, e., the difference between the radii.

Thus for circular holes, the relatively large-transverse-dimension segment has a first radius and the reduced-transverse-dimension segment has a second radius which is smaller than the first radius. Each of the inward-extending protrusions has a height which is roughly equal to the difference between these two radii.

Preferably each of the inward-extending protrusions is about 0.4 millimeter (0.015 inch) tall. This is in fact substantially equal to the radial difference in our preferred embodiments.

While a thickness also not exceeding 0.4 millimeter, as mentioned earlier, is preferable, such thickness would be appropriate for a relatively heavy duty contact—such as one made from formed brass of thickness roughly 0.5 millimeter (0.02 inch). For more typical or medium-duty articles we prefer to make each of the inward-extending protrusions less than 0.25 millimeter (0.01 inch) thick. More specifically we consider the optimal or ideal thickness for our preferred embodiment to be roughly within the range 0.20 to 0.23 millimeter (0.008 to 0.009 inch).

As to the geometry of our preferred embodiment, we consider it highly advantageous to use a contact in which each retaining element has a circumferential extent less than a full circumference of the terminal, and each of the inward-extending protrusions has a circumferential extent less than a full circumference of the hole. Preferably the protrusions are circumferentially disposed so that even in event of coincidental alignment of any of the retaining elements with any of the protrusions during installation—and consequent obstruction of that retaining element by that protrusion—at least one of the retaining elements is engaged with the connector.

This condition is easily met by, for example, making the plurality of retaining elements consist of two retaining elements, substantially diametrally disposed; and making the plurality of inward-extending protrusions consist of three protrusions, substantially symmetrically disposed about the circumference of the hole. With such an arrangement, if each retaining element subtends—for instance—roughly thirty-five to forty degrees of arc about the circumference of the hole, it can be guaranteed that no more than one retaining-element/protrusion pair can coincide at any given time, provided only that each protrusion subtends less than about eighty to eighty-five degrees.

This may be regarded as the first of the previously mentioned advantages of making the protrusions very thin. As will momentarily be seen, however, the protrusions are preferably much smaller than eighty degrees in circumferential extent—and in fact typically subtend only about seven to nine degrees each.

We also prefer that each of the inward-extending protrusions be flexible enough to deform enough, in event of such coincidental alignment, to prevent damage to the terminal. This feature may be closely associated with making the protrusions very thin; we prefer that any torque applied to external wiring attached to the contact have the effect of deforming or even shearing off part of one of the protrusions, rather than damaging the terminal. In practice, as will be seen, the part of the protrusion that is typically subject to such damage is a different portion than that which centers the female contact in it its hole.

In our preferred embodiment, each of the inward-extending protrusions is longitudinally disposed along an interior surface of the hole; and at least near one end of the hole is tapered radially outward toward that end of the hole, to help guide a contact of a mating half connector into engagement with the terminal. Because we prefer that the protrusions be longitudinally disposed, extremely thin, and roughly twice as tall (radially with respect, to the hole) as they are wide (circumferentially), they may be aptly characterized as "ribs" or "vanes".

All of the foregoing operational principles and advantages of the present invention will be more fully appreciated upon consideration of the following detailed description, with reference to the appended drawings, of which:

BRIEF DESCRIPTION OF THE DRAWINGS

FIG. 1 is a side elevation, mostly in longitudinal section, showing a connector in accordance with preferred embodiments of our invention in which the centered female contact is in an external half connector, and the bared-wire rough pins are installed in a half connector that is internal to a can of luminaire ballast or other electrical unit;

FIG. 2 is a plan view, drawn partly broken away in longitudinal section, of the FIG. 1 external half-connector body (i.e., the half connector without the contact and without the wiring);

FIG. 3 is a front elevation of the same half-connector body;

FIG. 4 is a very greatly enlarged fragmentary view of a portion of the FIG. 1 longitudinal section, particularly showing detail in the region of the small-transverse-dimension segment of the through hole in the external half-connector body;

DETAILED DESCRIPTION OF THE PREFERRED EMBODIMENTS

Figure 5:
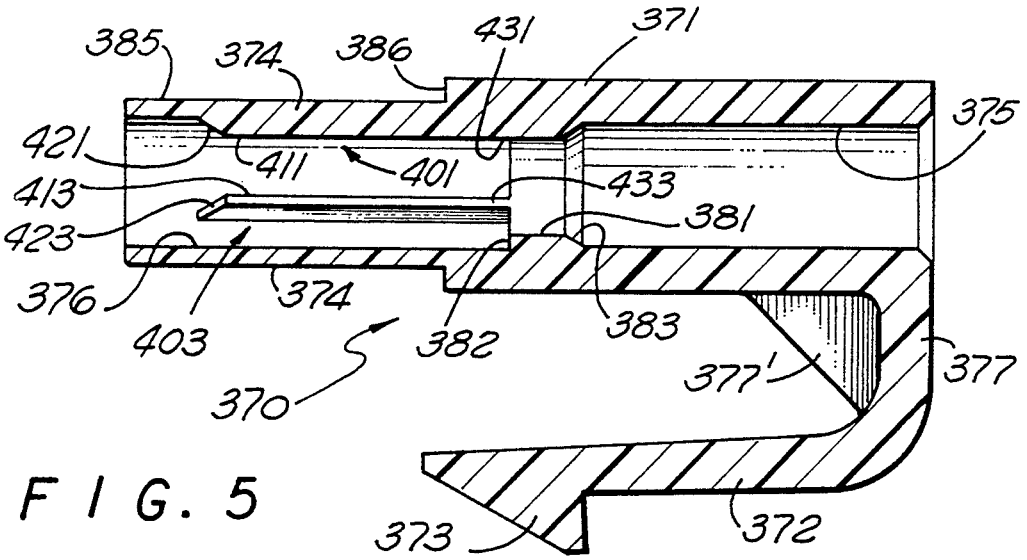
FIG. 5 is an enlarged side view in longitudinal section, similar to that of FIG. 1, but showing the external half-connector body alone, without the contact and wiring—and also without the mating half connector and the ballast can.
Figure 6:
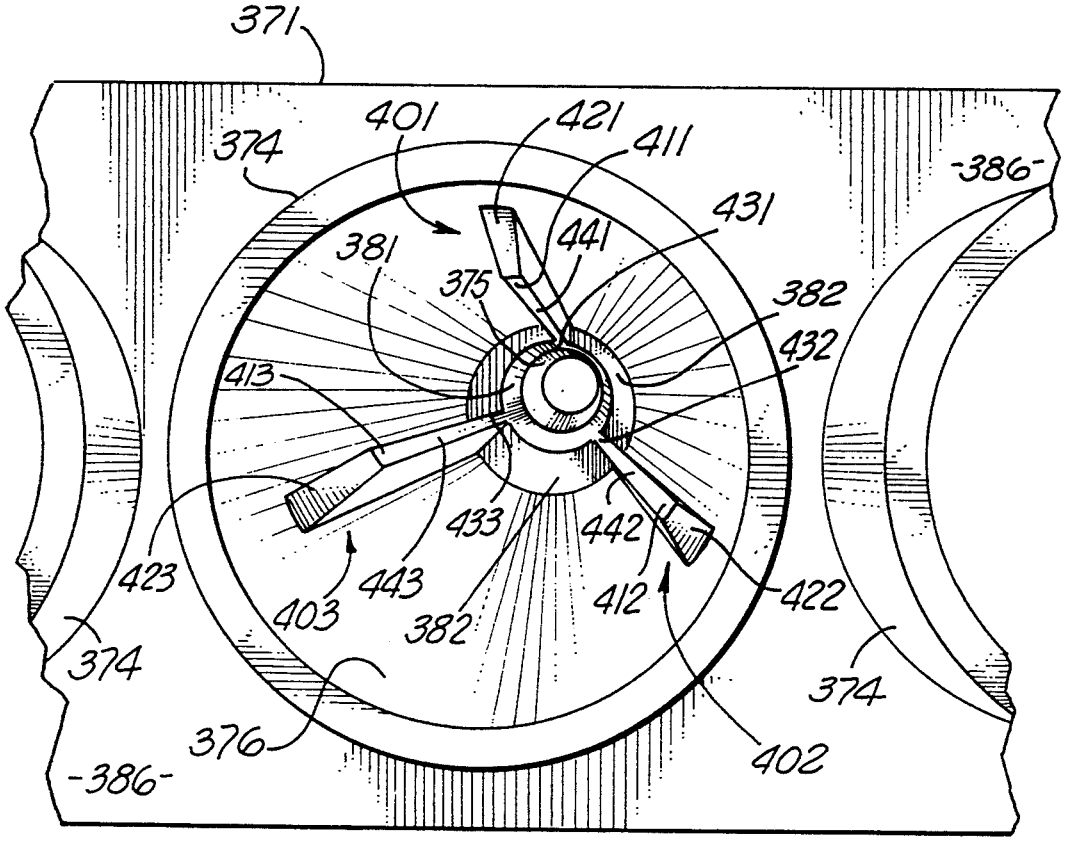
FIG. 6 is a greatly enlarged and exaggerated extreme wide-angle front perspective view looking into the mouth of one of the through-holes in the same external half-connector body.

The drawings illustrate an implementation of our invention in which bared-wire male pins 96 are in the internal half connector 50 of a luminaire ballast (or other electrical unit), and a centered female contact 111–119 is in the external half connector 370. Our invention serves equally well in the converse case—that is, an arrangement in which the centered female contact is in the internal half connector in a ballast etc. and the rough-construction pins in the external half—and the appended claims are accordingly applicable to both cases.

The previously mentioned parent patent document sets forth extensively many details of one context in which our present invention is particularly useful. Reference to that document is invited for a more complete exposition of all such matters.

In particular that earlier document explains the geometrical arrangements of the ballast can with its end wall 21 and longitudinally extended mounting flange 31, internal half connector 50, and wiring 91-96 from the electrical elements (not shown here) of the ballast to the internal half connector 50—as well as the external half connector with its wires 5–8, contacts 111–119, separate individual voltage-guarding sleeves 374, and securing hook 372–377. All such detail is hereby incorporated herein by reference.

In preferred embodiments of our invention, as the present document shows in FIGS. 1, 5, 7 through 9, and 11, radially protruding, longitudinally disposed thin vanes 401, 402, 403 are formed integrally with the internal cylindrical wall 376 of the through hole 375–381–376. These vanes 401–403 gently center the female contact 111–119 within the forward (mating) end of the large-transverse-dimension segment 376 of the through-hole.

At the rear end of each vane 401, 402, 403 is a respective root portion 431, 432, 433 that is substantially continuous with the annular front wall 382 of the internal flange 381–382 in the through-hole. At the other (forward) end of each vane is a respective tip segment 421, 422, 423, which is tapered to help guide a male pin into the contact 111–119.

Between these two ends of each vane 401, 402, 403 are respective forward portions 411, 412, 413 and central portions 441, 442, 443. These are the portions of the vane that hold the bell 113 and forward part of the barrel 111 centered the hole 376.

Because the rear portions of the contact 111–119 are held closely within the small-dimension segment 381 and in any event are remote from the point of entry of a male pin 96 into the forward end of the hole 376, the rear portions do not require such additional centering. Accordingly the important part of this centering action is near the mouth of the hole.

The retaining elements 117–118 (usually expansible springy tangs) of the contact 111–119 have their greatest radial enlargement at the other end of the large-dimension segment of the hole—namely, at the rear of that segment, adjacent to the small-dimension segment 381. Because of these geometrical relationships, damage to the vanes 401–403 by the retaining elements 117–118 is acceptable.

Shortly we will analyze in detail the potential for such damage. As will be seen, such damage can occur predominantly or entirely at the rear of the large-dimension segment of the hole, remote from the parts 411, 412, 413; 421, 422, 423 of the vanes that perform the centering function.

Each female contact is formed from sheet metal as a generally cylindrical barrel 111 with a forward horn or bell 113 for receiving and guiding the mating male pin, and with a reduced-diameter neck 112 just rear of the horn 113 for affecting highly reliable wiping contact with the shaft 96 of the mating pin. Each female contact also has a pair of radially-outward-springing tangs **117*a*, 117*b* die-cut diametrally in the wall of the cylindrical barrel 111**.

As seen in FIG. 1 the root of each tang is continuous with the generally cylindrical barrel wall 111 at the front end of the tang. The portion of the tang that springs radially outward furthest from the contact barrel is thus the rear tip 118 of the tang.

The contact 111–119 with attached wire 8, 5 is inserted from the rear end of the connector until the entire lengths of both tangs **117*a*, 117*b* have passed through the internal flange 381–383 in the half-connector body 370 and until a stop 119 formed on the rear portion of the contact engages the annular frustoconical rear surface 383 of that flange 381–383**.

The stop 119 prevents further forward motion, and the rear tips **118*a*, 118*b* of both tangs 117*a*, 117*b* are then in position to spring radially outward. After a tang has sprung outward in that way, if rearward force is applied to the wire or terminal the tang tip 118*a* or 118*b* moves rearward only far enough to longitudinally seat against the annular front surface 382 of the flange 381–383; after that the seated tang tip 118*a* or 118*b*** resists further rearward motion.

Consequently the combined action of the stop 119 and the tangs 117–118 against the opposite annular surfaces 382, 383 of the internal flange 381–383 lock the contact in place within the half connector, against escape in either longitudinal direction. (Ordinarily in prior-art connectors the contact can be withdrawn rearward if desired, through use of a cylindrical extraction tool that is inserted into the clearance space about the contact to recompress the tangs radially; as will shortly be clear, in connectors according to our invention such a tool would damage the centering vanes—but a suitable forked (bifurcated or trifurcated) extraction tool can be safely employed instead to permit removal if desired.)

Figure 7:
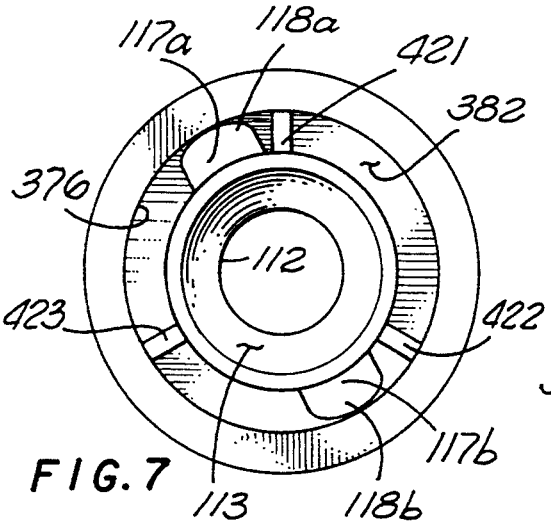
FIG. 7 is an enlarged front elevation looking into the mouth of one of the through-holes, with neither of the retaining elements (tangs) aligned with any of the centering protrusions (vanes)

With suitable selection of contacts that have tangs **117*a*, 117*b* not subtending too great a circumferential angle, and with suitable dimensioning of the centering vanes 401, 402, 403, a half connector in accordance with our invention can readily be made to permit the positional relationship shown in FIG. 7. Here the tangs 117*a*, 117*b* are rotationally positioned between the vanes 401, 402, 403**, with no interference and no obstruction or damage to either the tangs or the vanes.

As can be appreciated from considering FIG. 7, there are six different rotational orientations of the contact which produce equivalent noninterfering, nonobstructing interrelation between the tangs and vanes. Nevertheless it can also be appreciated that each of those six orientations is defined over a rather narrow rotational range.

More specifically, but, only for purposes of definiteness in discussion, if each tang is taken as subtending thirty-five degrees and each vane is taken as subtending nine degrees, and the tangs are assumed to be diametrally disposed about the contact barrel and the vanes assumed to be equiangularly disposed about the circumference of the hole, then in this simplified case the range of each noninterfering orientation is roughly sixteen degrees. Therefore the sum of all six of these angular ranges is ninety-six degrees, and the probability of obtaining such a noninterfering orientation upon insertion of the contact in a random orientation is about $96/360=0.27$ or roughly one in four.

Accordingly it is important to make suitable provision for the three-quarters of all assemblies in which an assembly worker is likely to insert the contact in an interfering orientation. As will now be explained, our invention is easily optimized to incorporate such provision.

Figure 8:
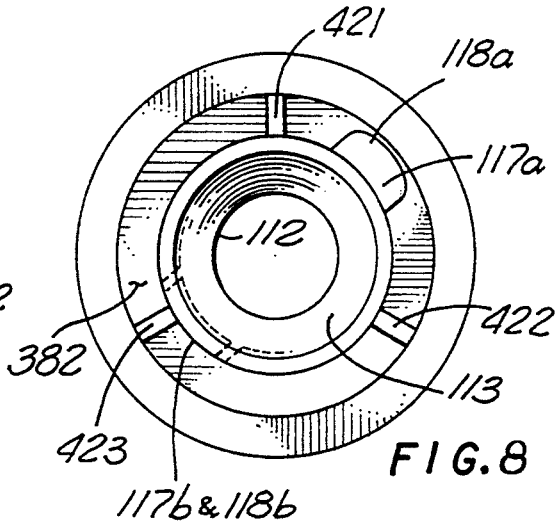
FIG. 8 is a like view but with one of the retaining elements aligned with and entirely obstructed by a rear portion of one of the protrusions.

FIG. 8 shows one thing that can happen when one tang **118*b* is in a position to strike one of the vanes 403—seen end-on in FIG. 8 and therefore identified by its tapered face 423, In this drawing the tang 117*b*/118*b* is unable to deploy notice ably, due to obstruction by the interfering vane 403. This result is rather improbable, but is at least theoretically possible because as mentioned earlier the rear portion 431, 432, 433 of each vane is continuous with and so is reinforced by the internal flange 381–383**, and accordingly is relatively strong near that point of attachment.

Thus, in event the contact is inserted only just far enough for the rear end of the tang to just barely clear the internal flange, as portrayed in FIG. 8 the tang 117*b*, 118*b* may not be strong enough to significantly deform the rear end of the vane 403 (seen as 423). In such a geometrical case, however, the opposite tang 117*a*, 118*a* is necessarily in an orientation well separated rotationally from the other two vanes 421, 422 and therefore able to deploy fully.

Figure 9:
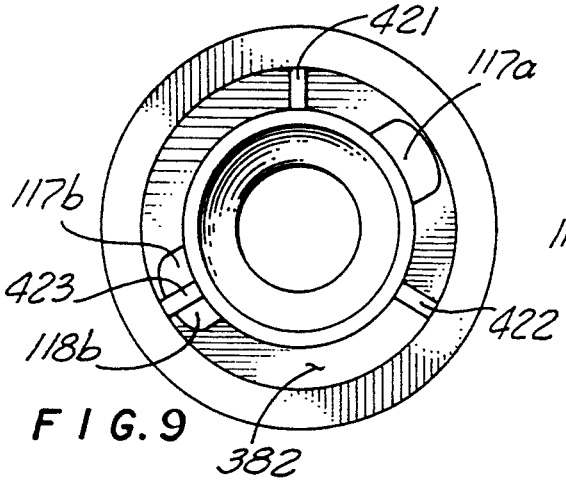
FIG. 9 is a like view but with the retaining element only partially obstructed by a rear portion of one of the protrusions.
Figure 10:
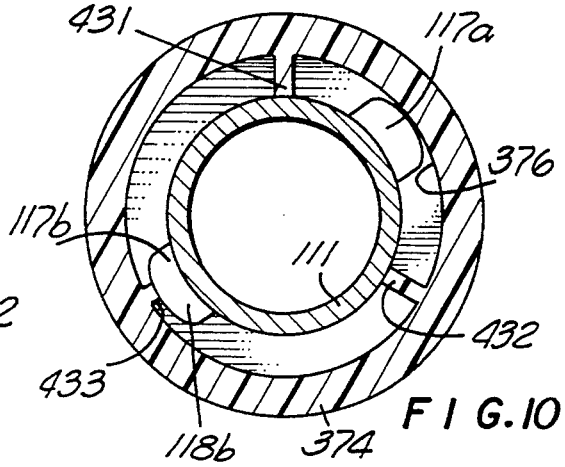
FIG. 10 is a cross-sectional view showing the FIG. 9 situation at a point along the length of the through-hole that is just forward from the small-transverse-dimension segment (internal flange)

We have determined that in such an extreme situation even this single-tang 117*a* retention is sufficiently strong to prevent rearward withdrawal of the contact. In most cases, however, the obstructed tang 117*b*, 118*b* strikes the vane 403 sufficiently far forward, and/or with sufficient snapping force or jerk, to at least partially crush the rear end 433 of the vane 403 as shown in FIGS. 9 and 10.

In this situation which is much more probable than the FIG. 8 case—the obstructed tang tip 118*b* is deployed radially outward by some fraction of the distance from the contact barrel 111 proper to the large-transverse-dimension cylindrical wall 376 of the hole. Here the single-tang 117*a* retention provided as in FIG. 8 is supplemented by an additional footing of the partially extended opposite tang 117*b*, and any withdrawal force is resisted even more strongly.

It will be recalled that the rear end of the contact remains attached to a wire 8, 5. In the cases of greatest interest for our purposes this wire is rather stiff.

Ordinarily after insertion of each terminal this stiff wire transmits to the contact both longitudinal thrusts and torques at many times during handling, shipping, installation etc. of these assemblies. These forces and torques arise from environmental vibration and from manual manipulations.

We deem it very probable that in the course of such a history the contact is rotated enough to carry the undeployed or partially deployed tang 117*b* of FIGS. 8 through 10 into one of the noninterfering orientations typified in FIG. 7. Hence even in a case of initial interference and obstruction as in FIG. 8, or FIGS. 9 and 10, by the time the assembly is actually in service both tangs 117*a*, 117*b* are likely to be fully extended and fully operative as in FIG. 7.

Figure 11:
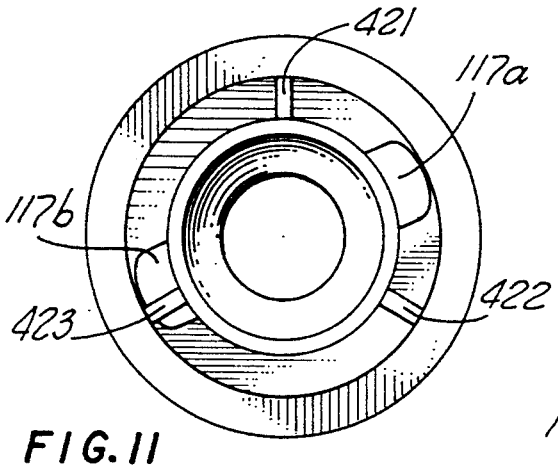
FIG. 11 is a front elevation like FIGS. 7 through 9, but with one of the retaining elements severing or reaming out a rearward portion of one of the protrusions.
Figure 12:
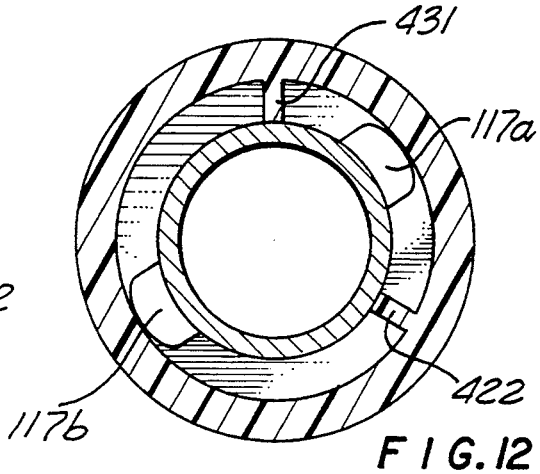
FIG. 12 is a cross-section like FIG. 10 but showing the FIG. 11 situation.

Still another case of interest appears in FIGS. 11 and 12. In this situation a tang 117*b*—which may be either initially obstructed or not—has rotated after initial installation in such a way as to slice through the rear end (433, but no longer present to be illustrated) of a vane 403, seen as 423. In fact, as will be appreciated, it is theoretically possible for one wire (especially, for example, the first wire installed in the connector) to be rotated enough to slice through the rear ends of all three vanes 401–403.

One result is that both tang tips 118*a*, 118*b* deploy fully, providing full retaining strength to resist any withdrawal force, It must be asked, however, what effect such damage may have upon the efficacy of the centering means.

In any such situation the contact remains locked against forward motion by engagement of the contact stop 119 with the rear annular surface 383 of the internal flange 381–383 in the half-connector body 370, as described earlier. Therefore such damage is limited to the rear end or root 431, 432 or 433 of the damaged vane (or vanes)—remote from the front portions 411, 412, 413 and middle portions 441, 442, 443 of the vanes that operate to center the contact—and accordingly the centering effect of the vanes is substantially unimpaired.

In all the cases of FIGS. 8 through 12, a condition created which would be entirely acceptable even if the connector 370 were deliberately molded that way in the first place—namely, an undercutting of the vanes 401–403 behind the portions 411–413, 441–443 that operate as centering means. To state this point more precisely, such undercut geometry would be acceptable except that molding the part in that way would be unduly expensive; this point was introduced in an earlier section of this document, relating to the relative cost and undesirability of providing additional mold pins to be withdrawn laterally in a double-pull molding operation.

In fact, except for the added cost and production time required, it would be unobjectionable to form integral centering bosses, or an integral centering ring, or any analogous undercut feature, only near the forward mouth of each hole. Such structural elements would position the forward end of each female contact at the center of its hole while leaving radial expansion space rearward—adjacent to the internal flange 381–383 (or like feature of the inside of the hole) that engages the retaining elements 117*a*, 117*b* of the contact.

Such molded undercut features are believed to be within the ambit of our invention and so are within the scope of certain of our appended claims. We prefer, however, not to use centering means having that type of geometry; the reason is that undercut geometries would be incompatible with our ideal goal of extremely low manufacturing cost in a molded part.

We have said that in our invention the integral centering means preferably comprise a plurality of protrusions from the interior wall of the through-hole—and even more preferably comprise at least three such protrusions. From the foregoing discussion the latter preference can now be appreciated:

with only two protrusions, the contact would be able to escape from between the protrusions and accordingly centering would not occur—unless the protrusions either (1) had a rather large circumferential extent or (2) were specially formed to engage outward-deflecting features of the contact; and with two protrusions, if diametrally disposed, it would not be straightforward to guarantee effective deployment of at least one of two diameteral tangs as described above.

Furthermore if the protrusions were specially formed engage the contact and so capture it for centering purposes, then there would arise an objectionable need for rotational orientation to align the protrusions with the mating features of the contact. Such orientation might call for added assembly time, in the same way as discussed in the prior-art section of this document relative to square contacts.

If the two protrusions were of greater circumferential extent for effectiveness in centering, then it would be less likely for the tangs or other centering means to be able crush or slice the root portions (near the internal flange) of the centering means as described in connection with FIGS. 9 through 12. Reliance then would be more fully placed upon single-tang retention.

These limitations, however, are at least theoretically susceptible to cure. For example, as to the need for rotational orientation during assembly, possibly cooperative self-preorienting structures might be formed in the contact and in the rear segment of the through-hole.

Such structures might at least partially reduce the time or effort, or both, required for rotational orientation. Accordingly the use of two protrusions while not now seen as optimal is nevertheless believed to be within the scope of our invention.

In the drawings of this document, for purposes of definiteness and clarity the cross-sections of the ribs or vanes 401–403 are portrayed as generally rectangular, with squared corners. It will be understood, however, that these elements are very thin—optimally less than a fifth of a millimeter (a hundredth of an inch)—and that structures intentionally made so thin and flimsy may not readily support such well-defined surface features.

Furthermore no benefit or advantage is to be gained by forming the vanes with rectangular cross-sections. To the contrary, in the mold-maker's art it is likely to be relatively easier to use imperfectly square-cornered cutters—or even circular-form cutters—to form the grooves that will create the vanes or ribs.

Further yet, it is not required that the opposed surfaces of the vanes or ribs be parallel. Generally trapezoidal, semicircular, oval or irregular cross-sections—and in fact composites of these and other shapes—may be expected to serve as well.

In sum, the cross-sectional shapes of the ribs, vanes or other centering means are not considered critical to their effectiveness in centering, or to their interaction with the tangs or other retaining elements. Therefore, in preparing the tooling that creates the centering means, the mold-maker may be allowed considerable latitude with respect to cross-sectional detail—but such latitude should be informed by the functions (centering, and susceptibility to crushing or slicing) to be performed by these means.

In the analogous external half-connector body disclosed in our above-mentioned parent patent document, both the front and rear segments of each through-hole are dimensioned with provision for very slight taper, known in the molding art as "draft"—from nominal 3.35 millimeter adjacent the internal flange to 3.45 millimeter at the mouth of the hole (0.132 to 0.136 inch). This draft is provided to facilitate removal of the part from the mold.

In our present invention we prefer to dimension the part either with about that same draft or less. The frontal taper of each vane is marked, preferably about thirty degrees to the axis of the hole; and the foot of each taper should be inset from the mouth of the hole by a suitable distance in the range of about 2¼ to 3 millimeters (0.09 to 0.12 inch).

Other dimensions of the external half connector are generally as set forth in the parent patent document. As in the half connector described in that document, we prefer that the forward annular wall 382 of the internal flange 381–383 be conically tapered at five degrees—the portion radially further inward being also further forward, toward the mouth of the hole—to enhance seating of the tang tips 118*a*, 118*b* against that wall 382.

No flash is permitted in the interior of the through-hole. The half connector preferably is molded in material known in the industry by the commercial designator "F26SPC001" nylon.

We wish to clarify one semantic point in order to avoid any misunderstanding as to the meaning of our descriptions of the invention, and particularly the meaning of our appended claims. We have said that the relatively-large-transverse-dimension segment of the hole provides "transverse clearance about substantially the entire circumference of the terminal"; but also that in our preferred embodiment the centering means include protrusions that physically center the contact in the hole. These protrusions of course occupy some of the space which we have described as "clearance".

By the term "substantially", however, we make allowance for the very thin vanes or ribs. In other words, both statements are true because the thin vanes do not in substance interfere with the transverse clearance.

More specifically, as will be recalled this clearance is provided to permit operation of the tangs or other retaining elements. Those elements typically deflect outward from the contact shaft proper, after insertion through the small-dimension segment of the hole, to engage the wall of that segment and so prevent the contact from escaping rearward through that small-dimension segment.

Since the "substance" of the matter is that the clearance is present to receive that outward deflection of the tangs, and since the vanes either do not interfere with that deflection at all or interfere with it only in unimportant ways, it is reasonable to say that the clearance is present "substantially all about the circumference of the terminal". In any event, to remove all doubt we hereby define this phrase to mean "all about the circumference of the terminal except for relatively very small fractions of the circumference that are occupied by centering means"—for example, by the vanes.

It will be understood that the foregoing disclosure is intended to be merely exemplary, and not to limit the scope of the invention—which is to be determined by reference to the appended claims.

What is claimed is:

1. An inexpensive small electrical half connector for use in completing at least one electrical circuit, and comprising:

a small and very inexpensive half-connector body that defines at least one hole formed through the body for receiving a respective terminal;

at least one electrical terminal, each having at least one retaining element for engaging with the half-connector body to retain the terminal within the half connector; each hole having:

at least one segment of relatively large transverse dimension for receiving the respective terminal, with transverse clearance about substantially the entire circumference of the terminal, at least one segment of reduced transverse dimension, for receiving the respective terminal and engaging with the at least one retaining element of the respective terminal to retain the terminal, and integral means for approximately centering the terminal in the large-transverse-dimension segment of the hole; and means for ensuring, without in any rotational position of the terminal relative to the half-connector body, effective engagement between the at least one retaining element and its respective at least one reduced-transverse-dimension segment.

2. The half connector of claim 1, wherein:

each electrical terminal has at least two retaining elements disposed about the terminal exterior;

the centering means comprise a plurality of inward-extending protrusions from an inner wall of the large-transverse-dimension segment of the hole, for guiding the terminal; and the engagement-ensuring means comprise disposition of the protrusions circumferentially about the hole interior, in relation to disposition of the retaining elements circumferentially about the terminal exterior, such that in event of coincidental rotational alignment of any of the retaining elements with any of the protrusions, at least one other retaining element necessarily fits between the protrusions to engage the segment of reduced transverse dimension.

3. The half connector of claim 2, wherein:

each electrical terminal has exactly two retaining elements, disposed diametrally; and the centering means comprise exactly three inward-extending protrusions from an inner wall of the large-transverse-dimension segment of the hole, disposed equiangularly about the hole, for guiding the terminal.

4. The half connector of claim 1, wherein:

the centering means comprise a plurality of inward-extending protrusions from an inner wall of the large-transverse-dimension segment of the hole, for guiding the terminal;

the engagement-ensuring means comprise sufficient flexibility of each of the inward-extending protrusions to allow, in event of coincidental alignment between the at least one retaining element and any one of the protrusions, at least partial deployment of that retaining element against said alignment protrusion, to engage the reduced-transverse-dimension segment without damage to the terminal; and to provide said sufficient flexibility, each of the inward-extending protrusions is less than 0.4 millimeter (0.015 inch) thick.

5. The half connector of claim 4, wherein:

each of the inward-extending flexible protrusions has a height which is roughly equal to half the difference between the entire relatively large transverse dimension and the entire reduced transverse dimension; and the terminal has a forward portion that passes through the reduced-transverse-dimension segment, and a central portion that passes into but not through the reduced-transverse-dimension segment; said forward and central portions being, except for the at least one retaining element, of common external dimensions;

whereby the protrusions form with the reduced-transverse-dimension segment a substantially common, continuous guide surface for the forward and central portions of the terminal.

6. The half connector of claim 1, wherein:

the centering means comprise a plurality of inward-extending protrusions form an inner wall of the large-transverse-dimension segment of the hole, for guiding the terminal;

each hole is substantially circular in cross-section, said relatively large-transverse-dimension segment having a first radius and said reduced-transverse-dimension segment having a second radius which is smaller than the first radius;

each of the inward-extending protrusions has a height which is roughly equal to the difference between the two radii; and the portion of each terminal that passes into or through the reduced-transverse-dimension segment, except for the retaining elements, has an external surface that is substantially circular-cylindrical and that fits closely within the said second radius, and the reduced-transverse-dimension segment is much more rigid than the centering means, so that the reduced-transverse-dimension segment, rather than said centering means, provides a firm primary support for the terminal.

7. The half connector of claim 6, wherein:

to provide said height roughly equal to the difference between radii, each of the inward-extending protrusions is about 0.4 millimeter (0.015 inch) tall.

8. The half connector of claim 7, wherein:

each of the inward-extending protrusions is less than 0.25 millimeter (0.010 inch) thick.

9. The half connector of claim 7, wherein:

each of the inward-extending protrusions is roughly 0.20 to 0.23 millimeter (0.008 to 0.009 inch) thick.

10. The half connector of claim 1, wherein:

the centering means comprise a plurality of inward-extending protrusions from an inner wall of the large-transverse-dimension segment of the hole, for guiding the terminal;

each retaining element has a circumferential extent less than a full circumference of the terminal;

each of the inward-extending protrusions has a circumferential extent less than a full circumference of the hole;

the protrusions are circumferentially disposed so that even in event of coincidental alignment and obstruction of any of the retaining elements by any of the protrusions during installation, at least one retaining element is engaged with the connector.

11. The half connector of claim 10, wherein:

the plurality of retaining elements consists of two retaining elements, substantially diametrally disposed; and the plurality of inward-extending protrusions consists of three protrusions, substantially symmetrically disposed about the circumference of the hole;

whereby if either retaining element is coincidentally aligned with any one of the three protrusions, the other retaining element is positioned substantially between the other two of the three protrusions and therefore not obstructed by either of them.

12. The half connector of claim 10, wherein:

each of the inward-extending protrusions is flexible enough to deform enough, in event of said coincidental alignment, to permit at least partial deployment of one of said retaining elements against the aligned protrusion without damage to the terminal.

13. The half connector of claim 10, wherein:

each of the inward-extending protrusions is longitudinally disposed along an interior surface of the hole and extends substantially to the mouth of the hole to apply centering guidance to the terminal near a forward tip of the terminal.

14. In combination, an inexpensive small electrical connector for use in completing at least one electrical circuit, and comprising:

a small and very inexpensive half-connector body that defines at least one hole formed through the body for receiving a respective terminal;

at least one electrical terminal, each having at least one retaining element for engaging with the half-connector body to retain the terminal within the half-connector body; and a small and very inexpensive half-connector body that defines at least one hole formed through the body for receiving the at least one terminal respectively; each hole having:

each hole having:

at least one segment of relatively large transverse dimension for receiving the respective terminal, with transverse clearance about substantially the entire circumference of the terminal, at least one segment of reduced transverse dimension, for receiving the respective terminal and engaging with the at least one retaining element of the respective terminal to retain the terminal, and integral means for approximately centering the terminal in the large-transverse-dimension segment of the hole; and a mating half connector having at least one male pin that is formed as a bared end of a wire; and wherein:

the centering means comprise a plurality of inward-extending protrusions from an inner wall of the large-transverse-dimension segment of the hole, for guiding the terminal;

each retaining element has a circumferential extent less than a full circumference of the terminal;

each of the inward-extending protrusions has a circumferential extent less than a full circumference of the hole;

the protrusions are circumferentially disposed so that even in event of coincidental alignment and obstruction of any of the retaining elements by any of the protrusions during installation, at least one retaining element is engaged with the connector;

each of the inward-extending protrusions is longitudinally disposed along an interior surface of the hole;

at least near one end of the hole in the first-mentioned half connector, each of the inward-extending protrusions is tapered radially outward toward that end of the hole, to help guide the at least one male pin of the mating half connector into engagement with the terminal; and one of the half connectors is installed in a fluorescent-lighting ballast, and the other of the half connectors carries wires within a fluorescent luminaire.

15. An inexpensive small electrical half connector for use in completing a plurality of electrical circuits, and comprising:

a small and very inexpensive half-connector body that defines a plurality of generally circular-cross-section holes formed through the body for receiving respective terminals;

a plurality of electrical terminals, each having plural resilient tangs for engaging with the half-connector body, after installation therein, to retain the terminals within the half connector body; each hole having:

at least two segments of relatively large radius for receiving the respective terminal, with transverse clearance about substantially the entire circumference of the terminal, an internal flange of circular cross-section, separating the two segments, for receiving the respective terminal and engaging with the tangs of the respective terminal to retain the terminal, and integral means for approximately centering the terminal in one of the large-radius segments of the hole;

all portions of each terminal that pass into or through the circular-cross-section internal flange, except said tangs, having substantially circular cross-section;

wherein each terminal is assembled into the corresponding internal flange of its respective hole with no need for rotational alignment of the terminal relative to the internal flange;

said centering means comprising at least three thin, longitudinal vanes extending radially inward from an inner wall of said one large-radius segment of the hole, and spaced circumferentially about the hole, for guiding the terminal.

16. The half connector of claim 15, wherein:

each of the inward-extending protrusions is less than 0.25 millimeter (0.010 inch) thick.

17. The half connector of claim 16, wherein:

each of the vanes has a height which is roughly equal to the difference between the radius of the one large-radius segment of the generally circular hole and an internal radius of the circular-cross-section flange.

18. The half connector of claim 15, wherein:

each vane is roughly 0.20 to 0.23 millimeter (0.008 to 0.009 inch) thick.

19. The half connector of claim 15, wherein:

each vane is flexible enough to deform enough, in event of coincidental circumferential alignment with one of the tangs, to permit at least partial deployment of that tang without damage to the terminal;

wherein each terminal is further assembled past its corresponding internal flange and fully into its respective hole with no need for rotational alignment of the terminal relative to any feature of the hole.

20. An inexpensive small electrical half connector for use in completing a plurality of electrical circuits, and comprising:

a small and very inexpensive half-connector body that defines a plurality of generally circular-cross-section holes formed through the body for receiving respective terminals;

a plurality of electrical terminals, each having plural resilient tangs for engaging with the half-connector body, after installation therein, to retain the terminals within the half connector body; each hole having:

at least two segments of relatively large radius for receiving the respective terminal, with transverse clearance about substantially the entire circumference of the terminal, an internal flange, separating the two segments, for receiving the respective terminal and engaging with the tangs of the respective terminal to retain the terminal, and integral means for approximately centering the terminal in one of the large-radius segments of the hole;

said centering means comprising at least three thin, longitudinal vanes extending radially inward from an inner wall of said one large-radius segment of the hole, and spaced circumferentially about the hole, for guiding the terminal; and wherein at least near one end of the hole, each vane is tapered radially outward toward that end of the hole, to help guide a respective contact of a mating half connector into engagement with the terminal.

* * * * *

UNITED STATES PATENT AND TRADEMARK OFFICE

CERTIFICATE OF CORRECTION

PATENT NO. : 5,350,292
DATED : September 27, 1994
INVENTOR(S) : Stuart E. Sanders et al.

It is certified that error appears in the above-identified patent and that said Letters Patent is hereby corrected as shown below:

Column 12,
Line 59, delete “withouth”.

Column 15,
Delete lines 3-6, “a small and very inexpensive half-connector body that defines at least one hole formed through the body for receiving the at least one terminal respectively; each hole having:”.

Signed and Sealed this

Eleventh Day of March, 2003

JAMES E. ROGAN
*Director of the United States Patent and Trademark Office*